United States Patent [19]

Zedrosser

[11] Patent Number: 4,930,241

[45] Date of Patent: Jun. 5, 1990

[54] HAND-HELD FIREARM PROVIDED WITH A DETACHABLE SIGHT

[75] Inventor: Ulrich Zedrosser, Steyr, Austria

[73] Assignee: Steyr-Daimler-Puch AG, Vienna, Austria

[21] Appl. No.: 404,081

[22] Filed: Sep. 7, 1989

[30] Foreign Application Priority Data

Sep. 23, 1988 [AT] Austria ..... 2352/88

[51] Int. Cl.[5] ..... F41G 1/06; F41G 1/38

[52] U.S. Cl. ..... 42/100; 33/233

[58] Field of Search ..... 42/100, 102, 103; 33/233, 245, 250

[56] References Cited

U.S. PATENT DOCUMENTS

| | | | |
|---|---|---|---|
| 936,807 | 10/1909 | Pedersen | 33/233 |
| 2,030,312 | 2/1936 | Mossberg | 42/100 |
| 2,473,966 | 6/1949 | Olson | 33/233 |
| 2,563,849 | 8/1951 | Ledherz | 42/101 |
| 3,463,430 | 8/1969 | Rubin et al. | 42/101 |
| 3,764,219 | 10/1973 | Collins | 42/100 X |
| 4,200,989 | 5/1980 | Brouthers | 42/100 X |
| 4,208,821 | 6/1980 | Power | 42/100 X |
| 4,291,479 | 9/1981 | Lough | 42/103 |
| 4,742,636 | 5/1988 | Swan | 42/101 |

FOREIGN PATENT DOCUMENTS

| | | | |
|---|---|---|---|
| 196756 | 3/1958 | Austria . | |
| 2338191 | 2/1975 | Fed. Rep. of Germany . | |
| 930124 | 7/1963 | United Kingdom | 33/250 |

*Primary Examiner*—Charles T. Jordan
*Assistant Examiner*—Michael J. Carone
*Attorney, Agent, or Firm*—Marmorek, Guttman & Rubenstein

[57] ABSTRACT

A hand held firearm is provided with a detachable sight and a mount for mounting the detachable sight on the receiver of the firearm. The mount comprises a track, e.g., a rail track, which is provided on the top surface of the receiver of the firearm and adapted to slidably receive the detachable sight, at least one bore, which opens in the top surface of the housing at the bottom of the track, and a screw which is mounted on the detachable sight and extends into the bore. In order to provide the firearm with such a mount which can be operated in a simple and skillful manner, a fixing nut is rotatably mounted in the bore of the receiver. The screw which is connected to the detachable sight is screwed into the nut. The nut is adapted to be forced down in the bore against the force of a spring, and a knurled disk is provided, which is disposed on a laterally open slit of the receiver and is non-rotatably connected to and axially slidable relative to the fixing nut.

9 Claims, 1 Drawing Sheet

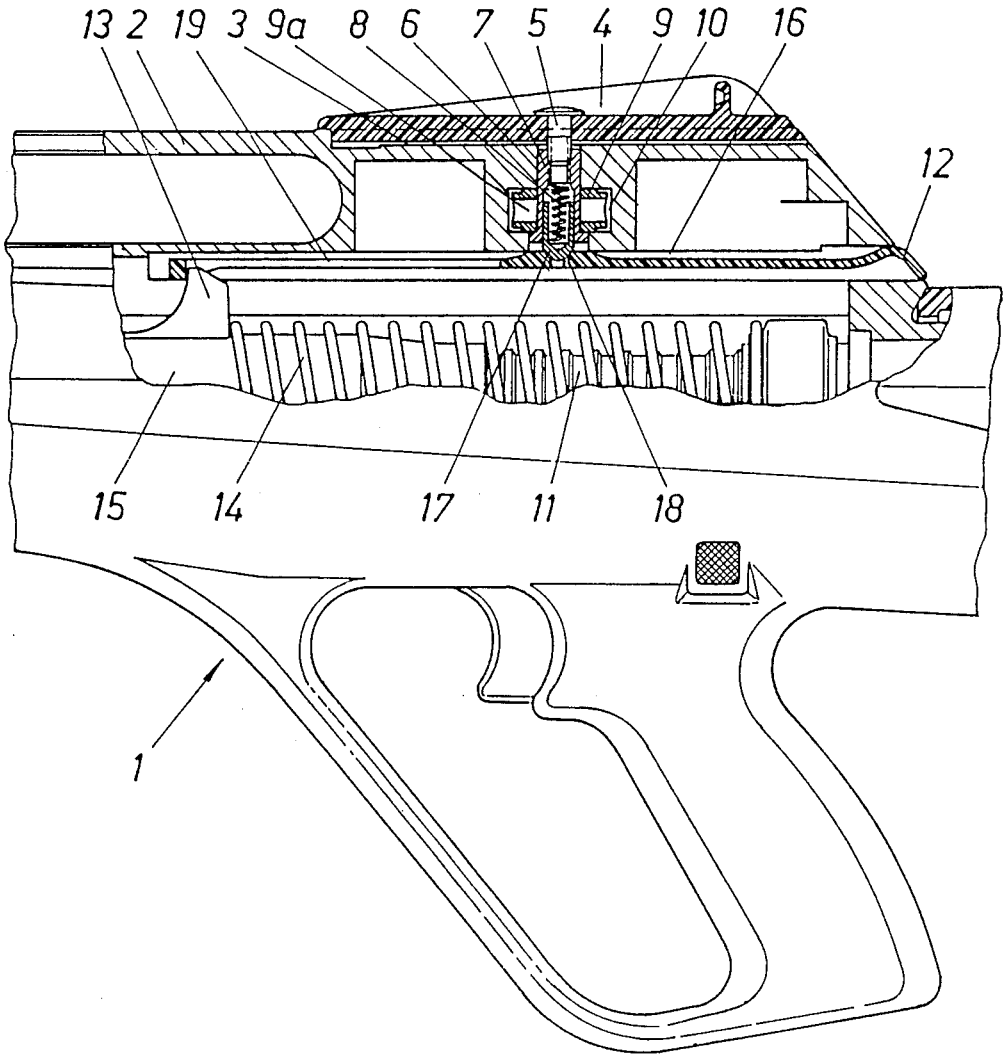
13
2
19
3
9a
8
6
7
5
4
9
10
16
12
15
14
17
11
18
1

HAND-HELD FIREARM PROVIDED WITH A DETACHABLE SIGHT

BACKGROUND OF THE INVENTION

1. Field of the Invention

This invention relates to a hand-held firearm that is provided with a detachable sight and specifically relates to the means by which said detachable sight is mounted on the receiver of the firearm. Said mounting means comprise a track, e.g., a rail track, which is provided on the top surface of the receiver of the firearm and adapted to slidably receive said detachable sight, at least one bore, which opens in the top surface of the housing at the bottom of the track, and a screw, which is mounted on said detachable sight and extends into said bore.

2. Description of the Prior Art

Numerous hand-held firearm are provided with detachable sights so that the firearm can be provided with a sight which has been selected in consideration of the actual shooting conditions and it is possible to use any of various rear sights which are available or a telescopic sight, a night sight and the like. The sights are provided at the bottom with a shoe, which is inserted into a rail track provided on the top surface of the receiver of the firearm and are fixed by means of a fixing screw. In the previous practice the fixing screw is usually mounted in a bore of the receiver and must be screwed into a mating tapped hole in the base of the sight. Because the sight must be forced in a centered position against the fixing screw during the rotation of the latter and owing to the upstanding screw cannot be inserted to a centered position in the rail track, the fixation of the detachable sight or the replacement of the detachable sight is a time-consuming and complicated operation.

Other known detachable sights are fixed by means of screws which are inserted from above through the body of the sight and screwed into tapped bores of the receiver of the firearm (U.S. Pat. No. 4,208,821). But the fixation of such detachable sights is also difficult and can be performed only with screwing implements and owing to a confined space often requires the detachable sight to be taken apart for the access to the fixing screws. It has also been proposed (Published German application No. 23 38 191) to secure a sight to a firearm by means of a fixing ring and a fixing member provided on the firearm. The fixing member receives a nut, and the sight proper is fixed by means of a fixing screw which is screwed into said nut. In that case the means for mounting the sight comprise a plurality of detachable parts and do not ensure an exact alignment of the sight relative to the firearm and for this reason such mounting means cannot be used to fix detachable sights.

It is known to provide a firearm not only with means for mounting a detachable sight but also with any of various means for adjusting such detachable sights. Such adjusting means comprise adjusting screws and adjusting nuts, which cooperate to adjust the detachable sight in vertical and/or lateral directions. In such arrangements the adjusting screw may additionally be used to hold the means for mounting the detachable sight in position (see U.S. Pat. Nos. 936,807 and 4,200,989 and Austrian patent specification No.196,756). But such adjusting means cannot be used as the only means for a rigid fixation of a detachable sight on the firearm so as to prevent any dislocation of the sight.

SUMMARY OF THE INVENTION

For this reason it is an object of the invention to avoid the disadvantages outlined hereinbefore and to provide a firearm which is of the kind described hereinbefore and in which the means for mounting the detachable sight have a relatively simple design and can easily be operated even when relatively large sights are to be mounted.

That object is accomplished in accordance with the invention in that a fixing nut is rotatably mounted in the bore of the receiver, the screw which is connected to the detachable sight is screwed into said nut, said nut is adapted to be forced down in said bore against the force of a spring, and a knurled disk is provided, which is disposed in a laterally open slot of the receiver and is non-rotatably connected to and axially slidable relative to said fixing nut. That arrangement ensures that when the screw of the detachable sight has been engaged with the nut, the detachable sight can be forced down into the rail track so that the fixing nut will also be forced down and the detachable sight can easily be forced against the firearm in a centered position and can easily be held against rotation until the knurled disk has sufficiently been rotated to screw the fixing nut on the screw so as to fix the detachable sight. Because the fixing nut is yieldable supported, the detachable sight can be inserted into the rail track in a perfectly centered position before it is fixed by screw means. As a result, the fixation by the screw means comprising exactly aligned parts can easily, quickly and exactly be effected and will not involve any difficulty even when two or more fixing screws are provided.

Within the scope of the invention the knurled disk may be provided at its periphery with radial bores, which have a diameter that matches a sling swivel pin of the hand-held firearm. Such sling swivel pins may be removed from the firearm and may be used as an implement for tightening or loosening the fixing nut.

In a hand-held firearm comprising a cocking slider, which is guided in the receiver above the barrel and is adapted to be latched in an initial position, a particularly desirable feature of the invention resides in that the bore in the housing opens into the track for the cocking slider and the spring which biases the fixing nut bears on a detent member, which protrudes into the track for the cocking slider and is adapted to cooperate with a detent recess and/or a guiding groove of the cocking slider. In that case the spring for resiliently supporting the fixing nut serves also as a spring for latching the cocking slider and a particularly economical and space-saving design is obtained, in which the means for mounting the detachable sight and the means for latching the cocking slider are combined.

BRIEF DESCRIPTION OF THE DRAWING

The drawing is a fragmentary side elevation showing partly in section a portion of a hand-held firearm which embodies the invention and is provided with a detachable sight.

DETAILED DESCRIPTION OF THE PREFERRED EMBODIMENT

The receiver 2 of a hand-held firearm 1 is provided on its top surface with a rail track 3, into which a detachable sight 4 has slidably been inserted. The detachable sight 4 is secured to the receiver 2 by a non-rotatable screw 5, which extends into a bore 6, which is formed in the receiver 2 and opens into the upwardly exposed bottom surface of the track 3 and extends in a direction which is normal to the longitudinal direction of the rail track 3. The bore 6 contains a fixing nut 7, which is rotatably mounted and is adapted to be screwed onto the screw 5 and is biased by a spring 8, which opposes a downward movement of the nut 7 in the bore 6. The fixing nut 6 can be rotated by a knurled disk 9, which is disposed in a laterally open slot 10, which intersects the bore 6 and extends through the receiver 2 in a lateral direction which is transverse to the longitudinal direction of the rail track 3 so that the knurled disk 9 is laterally accessible from the side of the receiver. The knurled disk 9 is non-rotatably connected to the fixing nut 7, e.g., by a hexagonal opening in the disk 9, and is axially slidable relative to the bore 6. As a result, the fixing nut 7 can be rotated by the knurled disk 9 but is axially displaceable in the bore 6. When it is desired to fix the detachable sight 4 to the receiver 2, the detachable sight 4 can be forced down to a centered position in the rail track 3 so that the screw 5 forces down the fixing nut 7 in axial alignment therewith. By a rotation of the knurled disk 9 the fixing nut 7 can then be screwed onto and tightened on the screw 5 to fix the detachable sight 4 to the receiver 2. To facilitate that tightening, the knurled disk 9 is provided at its periphery with angularly spaced apart radial bores 9*a*, into which an implement, such as a detachably mounted sling swivel pin of the firearm, may be inserted and used to rotate the knurled disk 9. The hand-held firearm which has been described comprises easily operable means for mounting the detachable sight 4 exactly in a desired position.

In the illustrated embodiment the hand-held firearm 1 comprises a cocking slider 12, which is disposed above the barrel 11 of the firearm and is guided in the longitudinal direction of the barrel by a slider track 16. In order to cock a firing mechanism, not shown in further detail, of the firearm the cocking slider 12 is engageable with a coupling element 13 of a second slider 15, which is displaceable in the longitudinal direction of the barrel 11 against the force of a return spring 14. In that case the means for mounting the detachable sight 4 may serve also to latch the cocking slider 12 in an initial position. In that case the bore 6 opens in the track 16 for the cocking slider 12 and the bore of the fixing nut 7 has an inwardly open, threadless end portion, in which a male detent member 17, which is biased by the spring 8, is axially slidably disposed. That spring 8 consists of a compression spring, which is mounted in the bore 6 and has a top end bearing on the fixing nut 7 and a bottom end bearing on the detent member 17. The detent member 17 protrudes into the track 16 for the cocking slider 12 and is adapted to cooperate with a detent recess 18 and with a longitudinal guiding groove 19, which are formed in the cocking slider 12. In that case the fixing nut 7 has the main function to fix the detachable sight 4 but also contains a detent member 17 for latching the cocking slider 12. The cooperation of the detent member 17 and the detent recess 18 and the guiding groove 19 defines stops for yieldably limiting the movement of the cocking slider 12. As a result, the cocking slider 12 can be held in its initial position by the detent member 17 extending into the detent recess 18 and the detent member 17 will extend into the groove 19 as the cocking slider is moved along the slider track 16 until the detent member 17 has arrived at the forward end of the groove 19. The cocking slider 12 may intentionally be pulled toward the rear along the track 16 so that the detent member 17 will be forced upwardly at the forward end of the guiding groove 19 and the cocking slider 12 can then be removed from the receiver 2 when it is desired to take the firearm apart.

I claim:

1. In a hand-held firearm comprising a receiver having a top surface, an upwardly open track provided on said top surface and having an upwardly exposed bottom surface, at least one bore, which is formed in said receiver and opens in said bottom surface, and a detachable sight, which is slidably mounted in said track and is provided with at least one non-rotatable screw, which extends into said at least one bore, the improvement residing in that said receiver is formed with a laterally open, transverse slot, which intersects said bore, a fixing nut is rotatably and axially slidably mounted in said bore and is screwed on said screw, a knurled disc is disposed in said slot and is laterally accessible and is non-rotatably connected to said fixing nut and axially movable relative to said bore, and a spring is mounted in said receiver and biases said fixing nut in an upward direction in said bore.

2. The improvement set forth in claim 1 as applied to a hand-held firearm in which said track is a rail track.

3. The improvement set forth in claim 1, wherein said knurled disk has a laterally exposed peripheral surface formed with a plurality of angularly spaced apart radial bores.

4. The improvement set forth in claim 3, wherein said firearm comprises a detachable pin, which is adapted to be inserted into each of said radial bores and operable to rotate said knurled disk.

5. The improvement set forth in claim 4, wherein said pin consists of a sling swivel pin.

6. The improvement set forth in claim 1 as applied to a hand-held firearm comprising a barrel, which is mounted on said receiver, an internal slider track provided in said receiver and extending under said top surface, a cocking slider, which is mounted in said receiver above said barrel and in contact with said slider track and is slidable along said slider track from and to a predetermined initial position, and latching means for yieldably latching said cocking slider in said predetermined initial position, the improvement residing in that said bore opens into said slider track, said latching means comprise a male detent member, which extends in and protrudes downwardly from said bore into said slider track, and female detent means provided at the top of said cocking slider and arranged to latch said male detent member when said cocking slider is in said initial position and said spring is a compression spring extending in said bore and having a top end bearing on said nut and a bottom end bearing on said male detent member.

7. The improvement set forth in claim 6, wherein said female detent means comprise an upwardly open recess which is formed in said cocking slider and arranged to be axially aligned with said bore when said cocking slider is in said initial position.

8. The improvement set forth in claim 6, wherein said cocking slider is formed with an upwardly open guiding groove, which extends along said slider track and is adapted to slidably receive said male detent member as said cocking slider moves along said slider track.

9. The improvement set forth in claim 8, wherein said guiding groove is arranged to cooperate with said male detent member so as to limit the movement of said cocking slider away from said initial position.

* * * * *